US009822648B2

(12) United States Patent
Iyer et al.

(10) Patent No.: US 9,822,648 B2
(45) Date of Patent: Nov. 21, 2017

(54) BLOWER WHEEL

(71) Applicant: VISTEON GLOBAL TECHNOLOGIES, INC., Van Buren Twp., MI (US)

(72) Inventors: Jayanthi Iyer, Northville, MI (US); Yafei Zhou, Canton, MI (US)

(73) Assignee: HANON SYSTEMS, Daejeon-si (KR)

( * ) Notice: Subject to any disclaimer, the term of this patent is extended or adjusted under 35 U.S.C. 154(b) by 693 days.

(21) Appl. No.: 13/827,697

(22) Filed: Mar. 14, 2013

(65) Prior Publication Data

US 2014/0003947 A1 Jan. 2, 2014

Related U.S. Application Data

(60) Provisional application No. 61/666,027, filed on Jun. 29, 2012.

(51) Int. Cl.

| | |
|---|---|
| ***F04D 29/00*** | (2006.01) |
| ***F01D 5/30*** | (2006.01) |
| ***F04D 29/22*** | (2006.01) |
| ***F04D 29/28*** | (2006.01) |
| ***F04D 29/66*** | (2006.01) |

(52) U.S. Cl.

CPC ..... *F01D 5/30* (2013.01); *F04D 29/2216* (2013.01); *F04D 29/282* (2013.01); *F04D 29/661* (2013.01)

(58) Field of Classification Search

CPC ... F04D 29/282; F04D 29/281; F04D 29/2216
See application file for complete search history.

(56) References Cited

U.S. PATENT DOCUMENTS 2,628,419 A * 2/1953 Wilken ..... F04D 29/283 219/107
3,464,622 A * 9/1969 Dennis ..... F04D 29/283 416/178
D221,382 S * 8/1971 Bubb ..... D23/414
3,692,428 A * 9/1972 Bubb ..... F04D 29/282 416/187
D285,111 S * 8/1986 Hanson ..... 416/183
5,328,332 A * 7/1994 Chiang ..... F04D 29/281 416/186 R
5,588,803 A * 12/1996 Vetter ..... F04D 29/282 29/453

(Continued)

FOREIGN PATENT DOCUMENTS

DE 19531160 A1 * 2/1997 ..... B60H 1/00471
DE EP 1845266 A2 * 10/2007 ..... F04D 25/08

*Primary Examiner* — Charles Freay
*Assistant Examiner* — Christopher Bobish
(74) *Attorney, Agent, or Firm* — Shumaker, Loop & Kendrick, LLP; James D. Miller

(57) ABSTRACT

A blower wheel for use in a blower assembly is disclosed, wherein the blower wheel includes a hub, a concentrically arranged outer ring, and an array of spaced apart blades arranged on an outer periphery of the hub and extending between the hub and the outer ring. The hub includes a wave configuration formed therein. The wave configuration includes an annular array of crests and an annular of troughs alternately formed in at least one of an outer surface and an inner surface of the hub. The hub may also include an annular array of support members formed on the inner surface thereof.

14 Claims, 6 Drawing Sheets

(56) References Cited

U.S. PATENT DOCUMENTS

| | | | | |
|---|---|---|---|---|
| 6,095,752 | A * | 8/2000 | Gronier | F04D 25/082<br>416/186 R |
| 6,881,035 | B1 * | 4/2005 | Paulsen | F01D 5/14<br>416/183 |
| 8,382,563 | B2 | 2/2013 | Sievers et al. | |
| 2003/0039548 | A1 * | 2/2003 | Kim | F04D 29/282<br>416/186 R |
| 2003/0198556 | A1 * | 10/2003 | Kim | B29C 45/33<br>416/186 R |
| 2004/0247441 | A1 * | 12/2004 | Kim | F04D 29/282<br>416/179 |
| 2007/0053774 | A1 * | 3/2007 | Farag | F04D 29/282<br>415/206 |
| 2012/0251321 | A1 * | 10/2012 | Fuchibe | F04D 25/0613<br>416/185 |

* cited by examiner

| (in mm) | h1 | h2 | p |
|---|---|---|---|
| Option 1 | 28.1 | 37.4 | 0 |
| Option 2 | 22.6 | 37.4 | 0 |
| Option 3 | 16.7 | 34.1 | 5.5 |
| Ranges | 13-43 | 15-45 | 0-10 |

FIG. 10

BLOWER WHEEL

CROSS-REFERENCE TO RELATED APPLICATION

This application claims the benefit of U.S. Provisional Patent Application Ser. No. 61/666,027 filed Jun. 29, 2012, the entire disclosure of which is hereby incorporated herein by reference.

FIELD OF THE INVENTION

The invention relates to a blower wheel and more particularly to a blower wheel which optimizes efficiency and minimizes noise and vibration during an operation thereof.

BACKGROUND OF THE INVENTION

Centrifugal blowers are commonly used for directing a forced flow of air through an air duct. In a typical blower assembly, air is drawn into a housing through an air inlet and discharged from the housing through an air outlet. Blower assemblies typically include an electrically driven blower wheel that rotates in a predetermined direction in the housing. The blower wheel includes one or more arcuate blades, which draw the air into the blower wheel axially along an axis of rotation and discharge the air radially outwardly therefrom.

Typically, in climate control applications such as heating, ventilating, and air conditioning (HVAC) systems of a vehicle, the centrifugal blowers are required to operate effectively and efficiently over a range of operating conditions of the vehicle. However, current centrifugal blowers may produce an undesirable level of noise, vibration, and harshness ("NVH") caused by, for example, motor cogging torque and axial cogging forces, torque ripple, and axial ripple forces which excite vibration and resonant modes in the blower wheel structure.

Accordingly, it would be desirable to produce a blower wheel that maximizes performance and structural integrity, while minimizing a cost and optimizing modes of vibration thereof.

SUMMARY OF THE INVENTION

In concordance and agreement with the present invention, a blower wheel that maximizes performance and structural integrity, while minimizing a cost and optimizing modes of vibration thereof, has surprisingly been discovered.

In one embodiment, the blower wheel comprises: a hub having a first surface and a second surface, the hub including at least one of a wave configuration formed in at least one of the first surface and the second surface thereof and a plurality of support members formed in the second surface.

In another embodiment, the blower wheel comprises: a hub having a first surface and a second surface, the hub including a wave configuration having a plurality of crests and a plurality of troughs formed in at least one of the first surface and the second surface thereof; and at least one blade arranged on an outer periphery of the hub.

In yet another embodiment, the blower wheel comprises: a hub having a first surface and a second surface, the hub including a wave configuration having a plurality of crests and a plurality of troughs formed in at least one of the first surface and the second surface thereof, and an array of support members formed in the second surface thereof.

DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings in which:

FIG. 10 is a table showing various measurements of alternate support members of the blower wheels illustrated in FIGS. 1-3.

DETAILED DESCRIPTION OF EXEMPLARY EMBODIMENTS OF THE INVENTION

Figure 1:
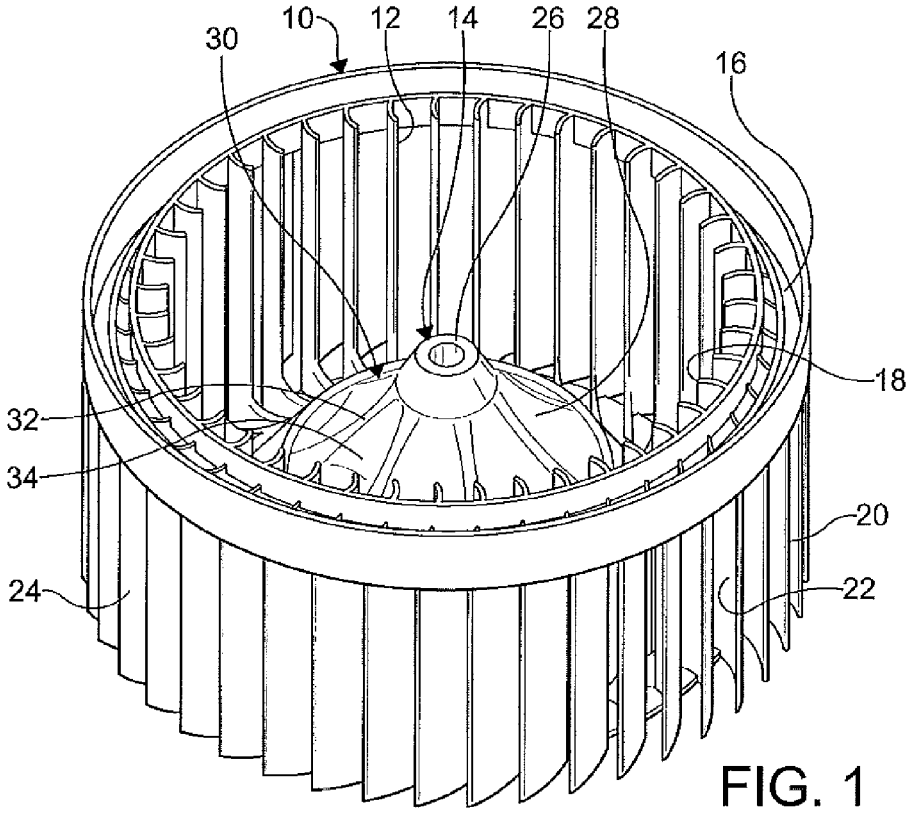
FIG. 1 is a top perspective view of a blower wheel in accordance with an embodiment of the invention.

The following detailed description and appended drawings describe and illustrate various exemplary embodiments of the invention. The description and drawings serve to enable one skilled in the art to make and use the invention, and are not intended to limit the scope of the invention in any manner.

FIGS. 1-9 show a blower wheel 10 according to the present invention. The blower wheel 10 can be used in any blower assembly as desired such as a blower assembly for an air conditioning unit of a vehicle, for example. Typically, the blower wheel 10 is disposed within a housing (not shown) and rotatably coupled to a motor (not shown) for causing a rotational movement of the blower wheel 10 within the housing described in U.S. Pat. No. 8,382,563 to Sievers et al., which is incorporated herein by reference in its entirety. It is understood, however, that the blower wheel 10 can be caused to rotate by any manual or automatic means as desired. The rotational movement of the blower wheel 10 in a first direction causes a flow of air received in an air inlet of the housing to flow at an increased dynamic pressure in a radially outward direction in respect of the blower wheel 10. The blower wheel 10 shown can be formed from any suitable material as desired such as a plastic material, for example.

As illustrated, the blower wheel 10 includes an annular array of spaced apart blades 12 extending between a hub 14 and a concentrically arranged outer ring 16. In certain embodiments, the blades 12 are arranged on an outer periphery of the hub 14 at equal intervals with respect to an axis of rotation of the blower wheel 10, although other intervals can be used. Additional or fewer blades 12 than shown can be employed if desired. Each of the blades 12 includes a substantially linear leading edge 18 and substantially linear trailing edge 20 extending from the hub 14 to the outer ring 16. Each of the blades 12 further includes a first surface 22 and an opposed second surface 24. In certain embodiments, the first surface 22 has a substantially concave shape in the direction of rotation of the blower wheel 10 and the second surface 24 has a substantially convex shape in the direction of rotation of the blower wheel 10. It is understood that the first surface 22 and the second surface 24 can have any shape as desired such as a substantially concave shape in the direction of rotation of the blower wheel 10, a substantially convex shape in the direction of rotation of the blower wheel 10, or a substantially planar shape, for example.

Figure 2:
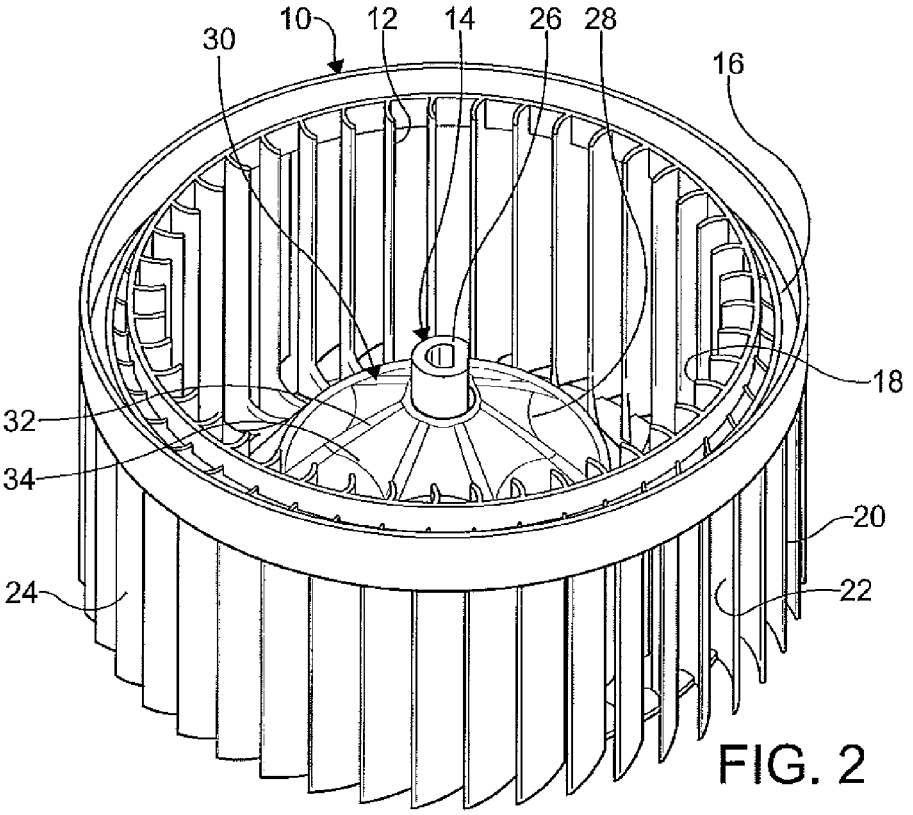
FIG. 2 is a top perspective view of a blower wheel in accordance with another embodiment of the invention.
Figure 3:
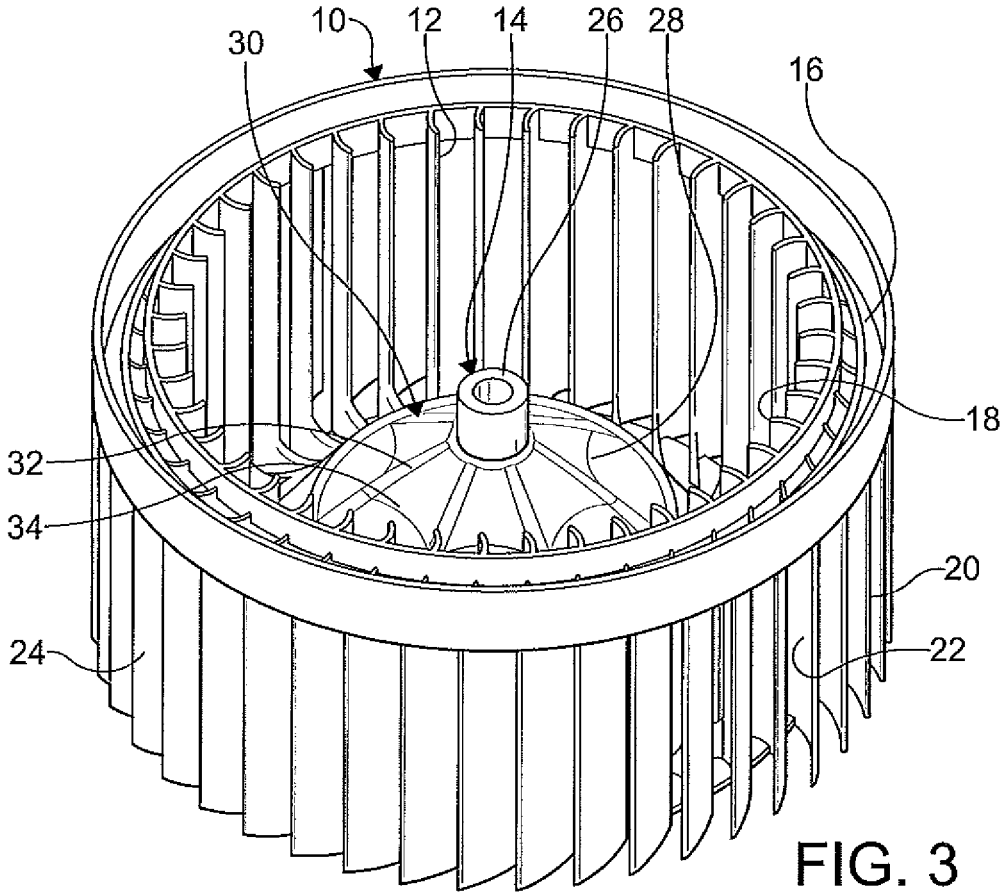
FIG. 3 is a top perspective view of a blower wheel in accordance with another embodiment of the invention.
Figure 4:
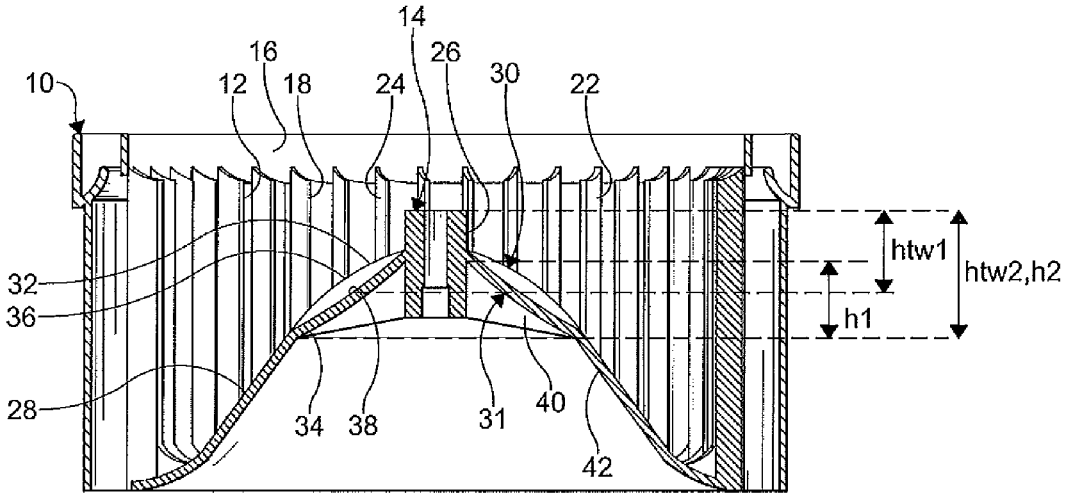
FIG. 4 is a cross-sectional view of the blower wheel illustrated in either FIG. 2 or 3.

The hub 14 is generally dome-shaped having a nose portion 26 formed at an apex thereof. As illustrated in FIGS. 1-3, the nose portion 26 can have any shape and size as desired. An outer first surface 28 of the hub 14 has a wave configuration 30 formed therein. The hub 14 includes a coextensive inner second surface 42. As shown, the inner surface 42 of the hub 14 has a wave configuration 31 formed therein, which corresponds to the wave configuration 30. It is understood that the inner surface 42 of the hub 14 can have any suitable shape and configuration as desired such as a generally conical shape having a smooth configuration, for example.

Each of the wave configurations 30, 31 increases a structural integrity of the blower wheel 10, as well as separates frequencies of noise produced by the blower wheel 10 to militate against amplification and resonance effects, and thereby minimize NVH. In certain embodiments, the wave configurations 30, 31 extend radially outward from the nose portion 26 to the leading edge 18 of the blades 12. In other embodiments shown in FIGS. 1-8, the wave configurations 30, 31 extend radially outward from the nose portion 26 to an intermediate position between the nose portion 26 and the leading edge 18 of the blades 12.

In certain embodiments, the wave configuration 31 formed in the inner surface 42 is substantially similar to the wave configuration 30 formed in the outer surface 28. For simplicity, only the wave configuration 30 formed in the outer surface 28 will be described hereinafter. The wave configuration 30 includes an annular array of crests 32 and an annular array of troughs 34 alternately formed in the outer surface 28 of the hub 14. As shown in FIGS. 1-5, a peak 36 of each of the crests 32 extending along a longitudinal axis thereof has a generally convex curvature with respect to the outer surface 28 of the hub 14. Conversely, as shown in FIGS. 1-5, a valley 38 of each of the troughs 34 extending along a longitudinal axis thereof has a generally concave curvature with respect to the outer surface 28 of the hub 14. Various wave configurations 30 can be employed as desired to maximize a performance and structural integrity of the blower wheel 10, while minimizing a cost and optimizing modes of vibration thereof.

Figure 5:
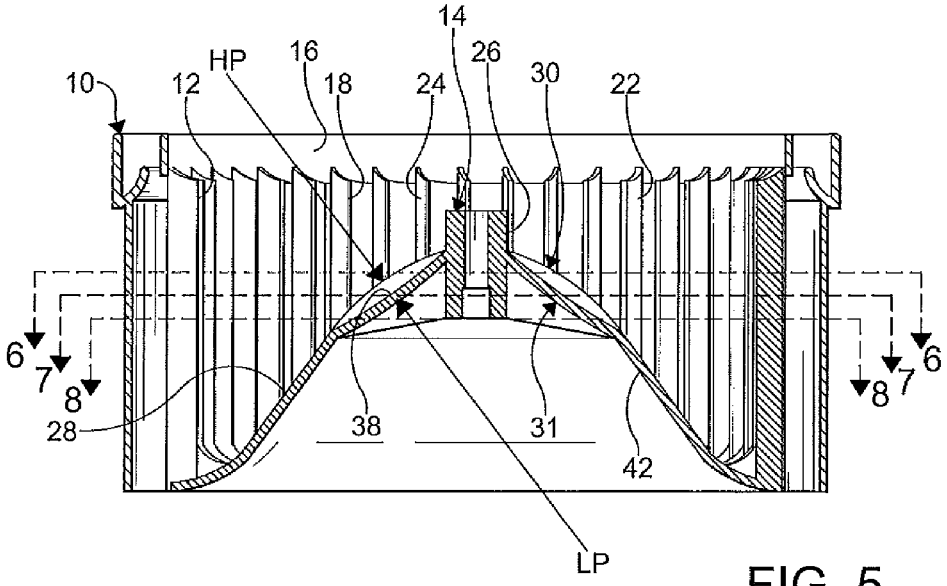
FIG. 5 is a cross-sectional view of the blower wheel illustrated in either FIG. 2 or 3.
Figure 6:
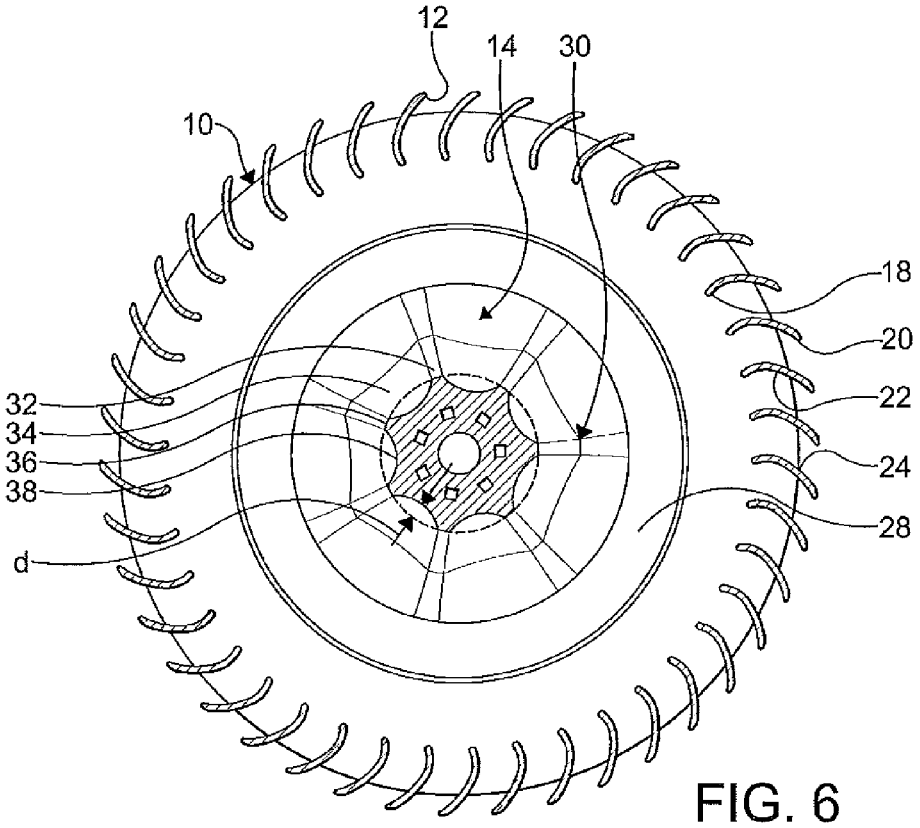
FIG. 6 is a cross-sectional view of the blower wheel illustrated in either FIGS. 2-3 taken along section line 6 of FIG. 5.
Figure 7:
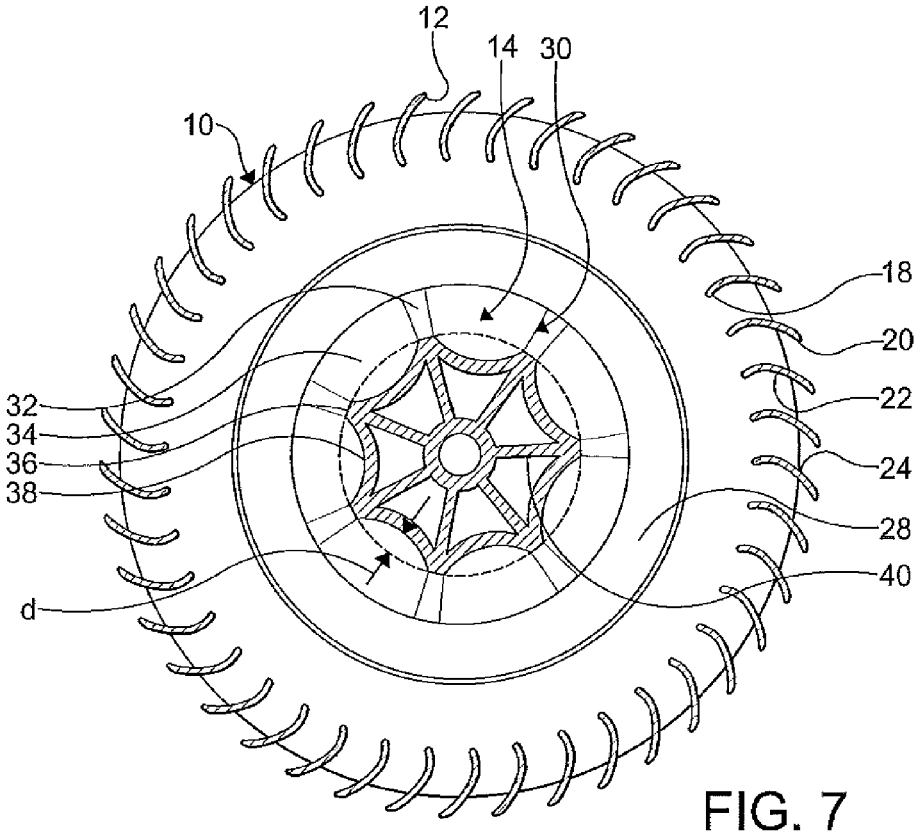
FIG. 7 is a cross-sectional view of the blower wheel illustrated in either FIGS. 2-3 taken along section line 7 of FIG. 5.
Figure 8:
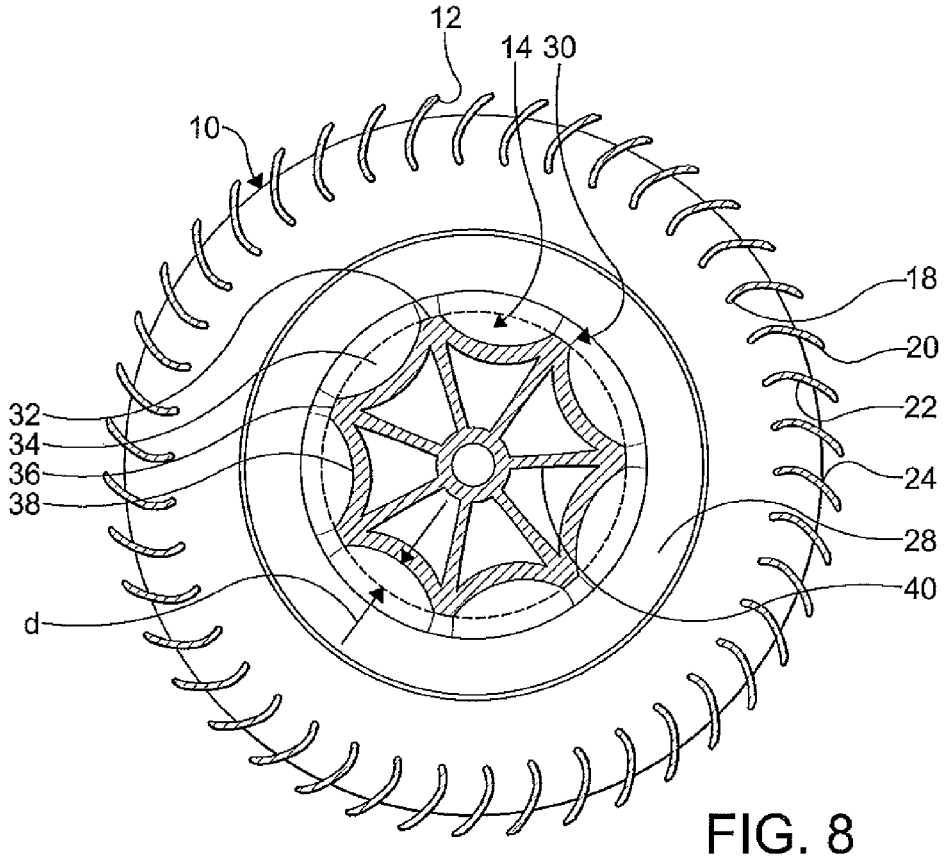
FIG. 8 is a cross-sectional view of the blower wheel illustrated in either FIGS. 2-3 taken along section line 8 of FIG. 5.

In a non-limiting example illustrated in FIG. 5, highest points (HP) of the peaks 36 of the crests 32 are aligned with lowest points (LP) of the valleys 38 of the troughs 34. A progression of the curvature of the peaks 36 and the valleys 38 of the non-limiting example is shown in FIGS. 6-8. A distance between the peaks 36 of the crests 32 and the valleys 38 of the troughs 34, also referred to as a depth of depression (d), of the non-limiting example is greatest between the highest point (HP) of the peaks 36 and the lowest point (LP) of the valleys 38 (shown in FIGS. 4-5). It is understood that the depth of depression (d) can be any distance as desired. For example, the depth of depression (d) can be in a range of about 2 mm to about 10 mm. A height ($htw_1$) from a planar surface of the nose portion 26 to the lowest point (LP) of the valleys 38 and a height ($htw_2$) from the planar surface of the nose portion 26 to a periphery of the wave configuration 14 can be any suitable heights as desired.

Figure 9:
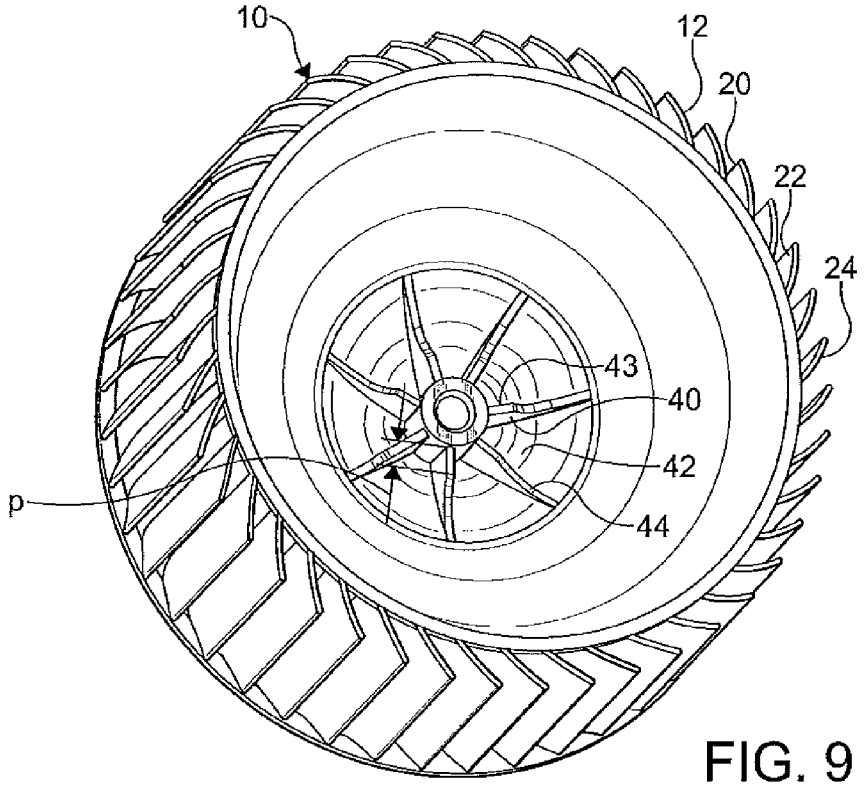
FIG. 9 is a bottom perspective view of the blower wheel illustrated in either FIGS. 2-3.

As shown in FIG. 9, the hub 14 may further include an annular array of support members (i.e. ribs) 40 formed on the inner surface 42 thereof. The support members 40 further increase the structural integrity of the blower wheel 10, as well as separate the frequencies of noise produced by the blower wheel 10 to militate against amplification and resonance effects, and thereby further minimize NVH. In certain embodiments, each of the support members 40 is formed on the inner surface 42 opposite the peaks 36 of the crests 32 of the wave configuration 30, as shown in FIGS. 7-8, and/or opposite the valleys 38 of the troughs 34 of the wave configuration 30. Those skilled in the art will appreciate that the support member 40 can be elsewhere on the inner surface 42 as desired. Each of the support members 40 shown has a generally arcuate shape. However, it is understood that the support members 40 can have any shape and size as desired. In a non-limiting example illustrated in FIG. 9, each of the support members 40 has a generally planar first portion 43 and a generally arcuate second portion 44. It is understood that the planar first portion 43 can have any suitable length (p) as desired. It is further understood that a height (h1) shown in FIG. 4 from a first end of the support members 40 adjacent the nose portion 26 to a second end of the support members 40 and a height (h2) from the planar surface of the nose portion 26 to the second end of the support members 40 can be any suitable heights as desired. The table illustrated in FIG. 10 provides non-limiting examples of the lengths (p) and the heights (h1), (h2) of the support members 40 employed in each of the alternate blower wheels 10 (Options 1-3) illustrated in FIGS. 1-3, respectively, as well as a non-limiting example of ranges of the lengths(p) and the heights (h1), (h2) of all of the alternate blower wheels illustrated in FIGS. 1-3.

In use the blower wheel 10 is driven by the motor and is caused to rotate about the axis of rotation. The rotation of the blower wheel 10 causes the air to flow through the air inlet of the housing. The blades 12 cause a change of direction of the air from a substantially axial direction parallel to the axis of rotation of the blower wheel 10 to a substantially radial direction perpendicular to the axis of rotation. Accordingly, the air flows axially through the air inlet into the blower wheel 10, and then flows radially outwardly from the blower wheel 10 into a scroll duct of the housing. Thereafter, the air flows out of the housing to a desired area.

From the foregoing description, one ordinarily skilled in the art can easily ascertain the essential characteristics of this invention and, without departing from the spirit and scope thereof, can make various changes and modifications to the invention to adapt it to various usages and conditions.

The invention claimed is:

1. A blower wheel, comprising:

a hub having a first surface and a second surface, the hub including a wave configuration formed in at least one of the first surface and the second surface thereof, and a plurality of support members formed in the second surface, the wave configuration extending radially outward from a nose portion of the hub, wherein the wave configuration includes a plurality of crests and a plurality of troughs formed in at least one of the first surface and the second surface of the hub, and wherein each of the support members is formed opposite at least one of a peak of one of the crests and a valley of one of the troughs, wherein the peak of each of the crests extending along a longitudinal axis thereof has a generally convex curvature with respect to at least one of the first surface and the second surface of the hub, and the valley of each of the troughs extending along a longitudinal axis thereof has a generally concave curvature with respect to at least one of the first surface and the second surface of the hub, wherein an axial distance between the peak of each of the crests and the valley of each of the troughs increases from a center of the hub to a first radius and decreases from the first radius to a second radius, the second radius radially outwardly from the first radius.

2. The blower wheel of claim 1, further comprising at least one blade arranged on an outer periphery of the hub.

3. The blower wheel of claim 2, wherein the wave configuration extends radially outward from the nose portion of the hub to a leading edge of the at least one blade.

4. The blower wheel of claim 2, wherein the wave configuration extends radially outward from the nose portion of the hub to an intermediate position between the nose portion and a leading edge of the at least one blade.

5. The blower wheel of claim 1, wherein the crests and the troughs are alternatingly formed in at least one of the first surface and the second surface of the hub.

6. The blower wheel of claim 1, wherein a highest point of the peak of each of the crests is aligned with a lowest point of a valley of the troughs.

7. The blower wheel of claim 1, wherein each of the support members has a generally arcuate shape.

8. The blower wheel of claim 1, wherein each of the support members has a generally planar first portion and a generally arcuate second portion.

9. A blower wheel, comprising:

a hub having a first surface and a second surface, the hub including a wave configuration having a plurality of crests and a plurality of troughs formed in at least one of the first surface and the second surface thereof, the wave configuration extending radially outward from a nose portion of the hub, wherein a peak of each of the crests extending along a longitudinal axis thereof has a generally convex curvature with respect to at least one of the first surface and the second surface of the hub, wherein a valley of each of the troughs extending along a longitudinal axis thereof has a generally concave curvature with respect to at least one of the first surface and the second surface of the hub, and an array of support members formed in the second surface thereof opposite at least one of the peaks of one of the crests and a valley of one of the troughs, wherein an axial distance between the peak of each of the crests and the valley of each of the troughs increases from a center of the hub to a first radius and decreases from the first radius to a second radius, the second radius radially outwardly from the first radius: and at least one blade arranged on an outer periphery of the hub.

10. The blower wheel of claim 9, wherein the wave configuration at least one of extends radially outward from the nose portion of the hub to a leading edge of the at least one blade and extends radially outward from the nose portion of the hub to an intermediate position between the nose portion and a leading edge of the at least one blade.

11. The blower wheel of claim 9, wherein the crests and the troughs are alternatingly formed in at least one of the first surface and the second surface of the hub.

12. The blower wheel of claim 9, wherein a highest point of the peak of each of the crests is aligned with a lowest point of the valley of the troughs.

13. A blower wheel, comprising: a hub having a first surface and a second surface, the hub including a wave configuration having a plurality of crests and a plurality of troughs formed in at least one of the first surface and the second surface thereof, and an array of support members formed in the second surface thereof, the wave configuration extending radially outward from a nose portion of the hub, wherein a peak of each of the crests extending along a longitudinal axis thereof has a generally convex curvature with respect to at least one of the first surface and the second surface of the hub, and wherein each of the support members is formed opposite at least one of the peak of one of the crests and a valley of one of the troughs, wherein the valley of each of the troughs extending along a longitudinal axis thereof has a generally concave curvature with respect to at least one of the first surface and the second surface of the hub, and wherein an axial distance between the peak of each of the crests and the valley of each of the troughs increases from a center of the hub to a first radius and decreases from the first radius to a second radius, the second radius radially outwardly from the first radius.

14. The blower wheel of claim 13, wherein each of the support members has a generally arcuate shape.

* * * * *